US007900566B1

(12) United States Patent
Bunker

(10) Patent No.: US 7,900,566 B1
(45) Date of Patent: Mar. 8, 2011

(54) PORTABLE CHAIR TRAY

(76) Inventor: Matthew Bunker, Waterbury, CT (US)

( * ) Notice: Subject to any disclaimer, the term of this patent is extended or adjusted under 35 U.S.C. 154(b) by 696 days.

(21) Appl. No.: 11/748,766

(22) Filed: May 15, 2007

(51) Int. Cl.
*A47B 37/00* (2006.01)

(52) U.S. Cl. ..... 108/42; 108/167; 297/170

(58) Field of Classification Search ..... 248/231.41, 248/231.71, 230.3, 292.12; 297/173, 174 R, 297/170; 108/42, 49, 5–10, 50.16, 94–99, 108/166, 167, 171, 145
See application file for complete search history.

(56) References Cited

U.S. PATENT DOCUMENTS

| | | | | | |
|---|---|---|---|---|---|
| 725,593 | A | * | 4/1903 | Schleuning | 108/49 |
| 822,809 | A | * | 6/1906 | Young | 108/1 |
| 1,247,367 | A | * | 11/1917 | Burchell | 312/204 |
| 1,628,247 | A | * | 5/1927 | Jones | 297/135 |
| 2,067,661 | A | * | 1/1937 | Ferrelle | 108/46 |
| 2,710,051 | A | * | 6/1955 | Greenberg | 108/6 |
| 2,804,126 | A | * | 8/1957 | Palmer | 297/160 |
| 3,042,937 | A | * | 7/1962 | Young | 108/49 |
| 3,586,367 | A | | 6/1971 | Cincotta | |
| 4,300,798 | A | * | 11/1981 | Musgrove et al. | 297/184.15 |
| 4,566,732 | A | * | 1/1986 | Ostergaard et al. | 297/174 R |
| D292,150 | S | | 10/1987 | Restin et al. | |
| 4,725,160 | A | * | 2/1988 | Wood | 403/95 |
| 4,779,884 | A | * | 10/1988 | Minati | 280/304.1 |
| 5,311,210 | A | * | 5/1994 | O'Brien et al. | 345/168 |
| 5,816,648 | A | * | 10/1998 | Baccili et al. | 297/159.1 |
| 5,865,124 | A | | 2/1999 | Wroe | |
| 6,017,085 | A | | 1/2000 | LaCroix et al. | |
| 6,685,264 | B2 | | 2/2004 | Mullen et al. | |
| 6,899,386 | B2 | | 5/2005 | Anton | |
| 7,267,253 | B2 | * | 9/2007 | McCoy et al. | 224/509 |
| D555,950 | S | * | 11/2007 | Hart | D6/509 |

* cited by examiner

*Primary Examiner* — Janet M Wilkens

(57) ABSTRACT

Disclosed is a tray for a portable chair. The tray may include a table attached to a support rod by a first linkage and a second linkage. The first linkage may include a first linkage slot. The tray further may include a clamp attached to the support rod.

15 Claims, 8 Drawing Sheets

PORTABLE CHAIR TRAY

BACKGROUND

1. Field

The information disclosed in this patent relates to a tray that may be attached to a portable chair.

2. Background Information

Portable chairs provide sitting convenience in a variety of situations. For example, electricians typically bring portable chairs to job sites to have a place to sit while eating lunch. However, most electricians use buckets or boxes to place their food on while eating.

Others use portable chairs in a variety of settings but often lack a stable, flat surface from which to eat or work. For example, homeowners, campers, anglers, and outdoor sporting event spectators utilize portable chairs but typically use a makeshift item to support their equipment or food. Handicap people confined to wheelchairs often have immediate needs for a tray that may function as an eating, writing, drawing, or studying table or platform, but lack the ability to find any makeshift item to serve that purpose. Thus, there is a need for a stable, flat surface that may be attached to a portable chair.

SUMMARY

Disclosed is a tray for a portable chair. The tray may include a table attached to a support rod by a first linkage and a second linkage. The first linkage may include a first linkage slot. The tray further may include a clamp attached to the support rod.

DETAILED DESCRIPTION

Figure 1:
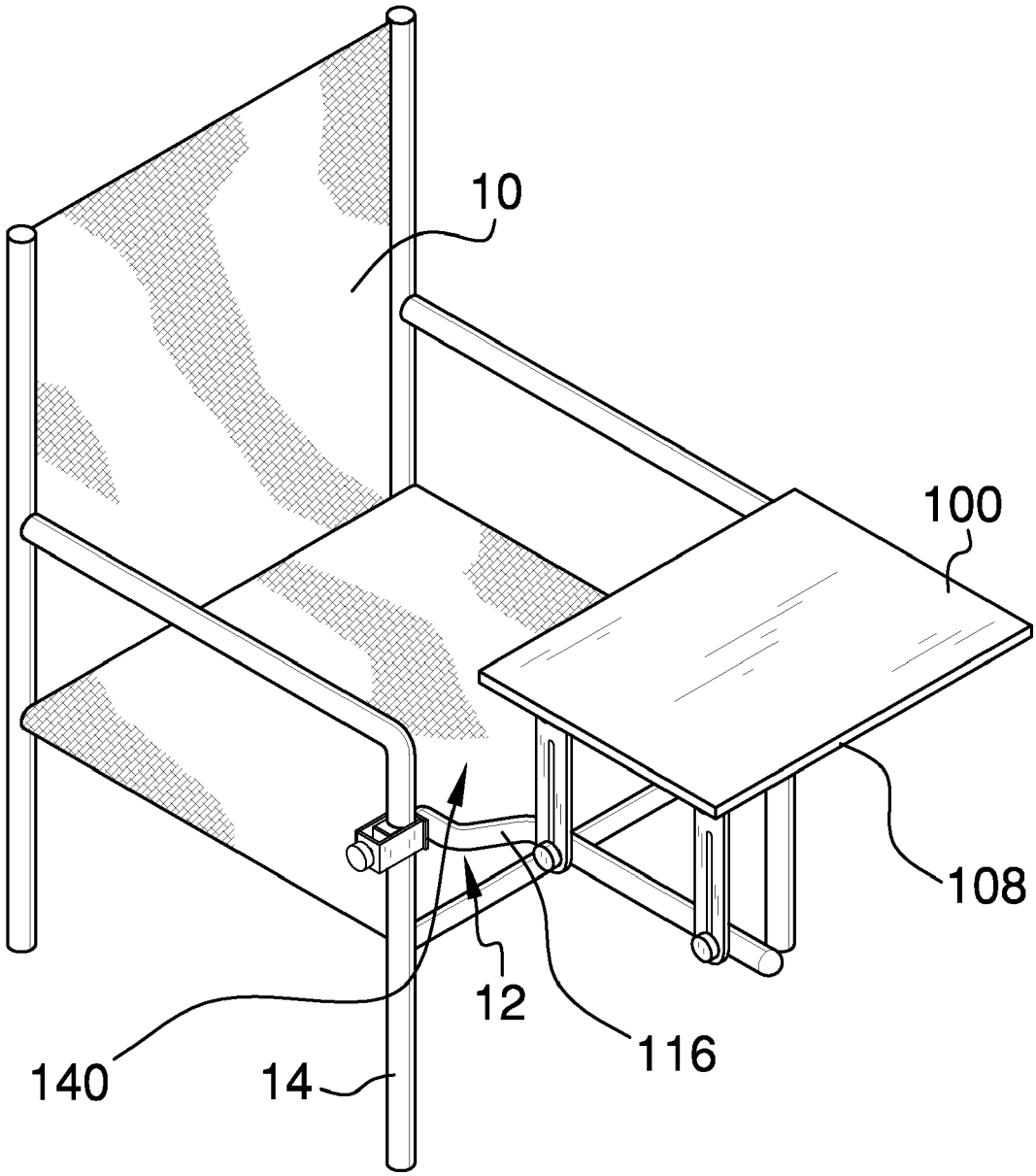
FIG. 1 is an isometric view of a tray 100.

FIG. 1 is an isometric view of a tray 100. Tray 100 may provide a flat work surface for those sitting in a chair 10 having a chair opening 12. Chair 10 may be a portable chair, such as a folding chair, a lawn chair, and a wheelchair. Through an assembly of part, tray 100 may be attached to a chair upright portion 14 of chair 10 and manipulated into various positions to assist in sitting activities, such as eating, writing, drawing, and studying. Tray 100 may be rotated away from chair opening 12 to permit a person to sit and leave chair 10. Tray 100 may be removed from chair 10 and collapsed into a low profile that takes up minimal storage and transportation space.

Figure 2:
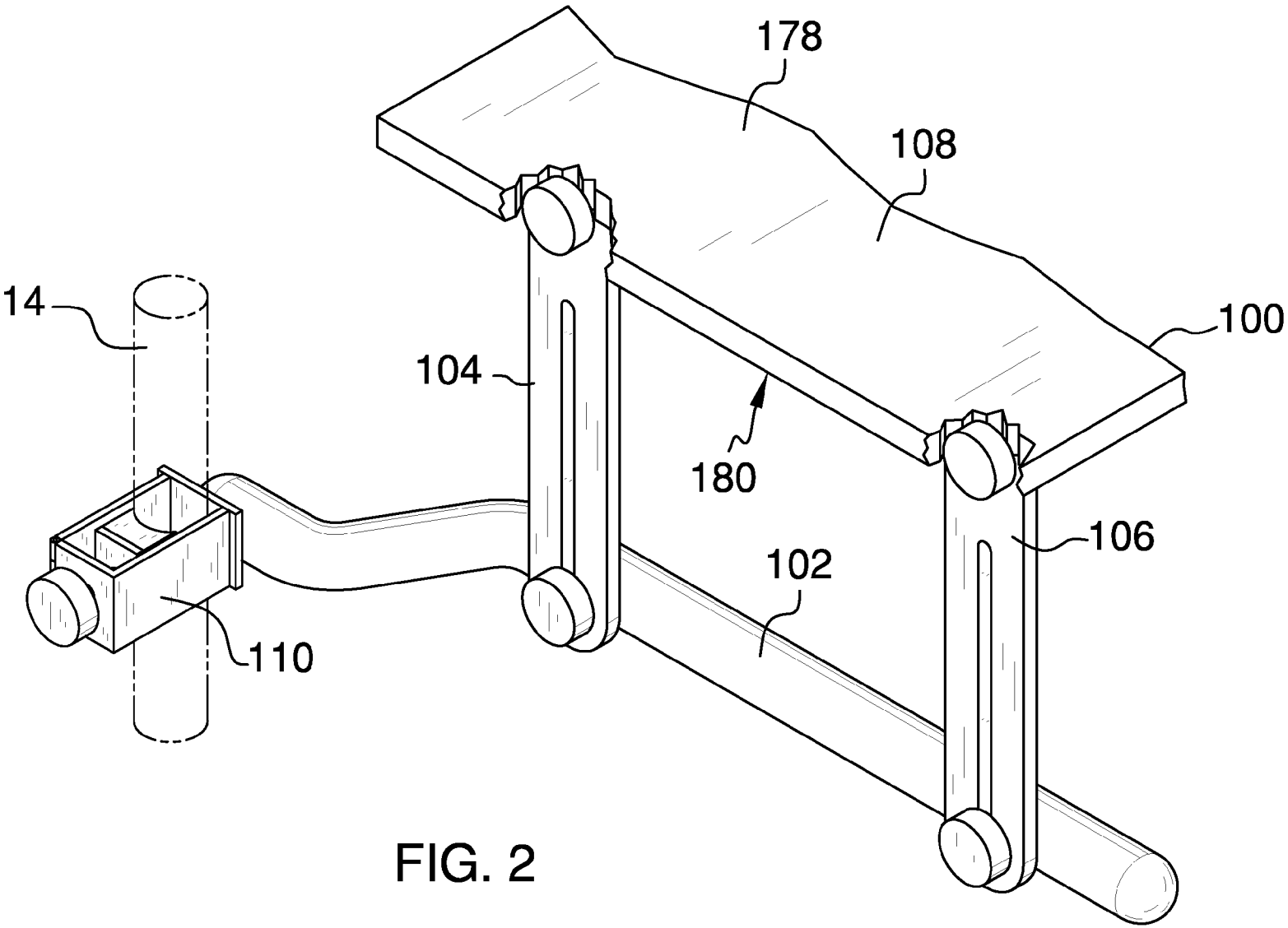
FIG. 2 is an enlarged, isometric partial view of tray 100.

FIG. 2 is an enlarged, isometric partial view of tray 100. Tray 100 may include a support rod 102, a first linkage 104, a second linkage 106, a table 108, and a clamp 110. First linkage 104 and second linkage 106 may be attached between table 108 and support rod 106. Support rod 106 may be attached to clamp 110 to form tray 100. Clamp 110 may be utilized to attach tray 100 to chair upright portion 14 of chair 10.

Figure 3:
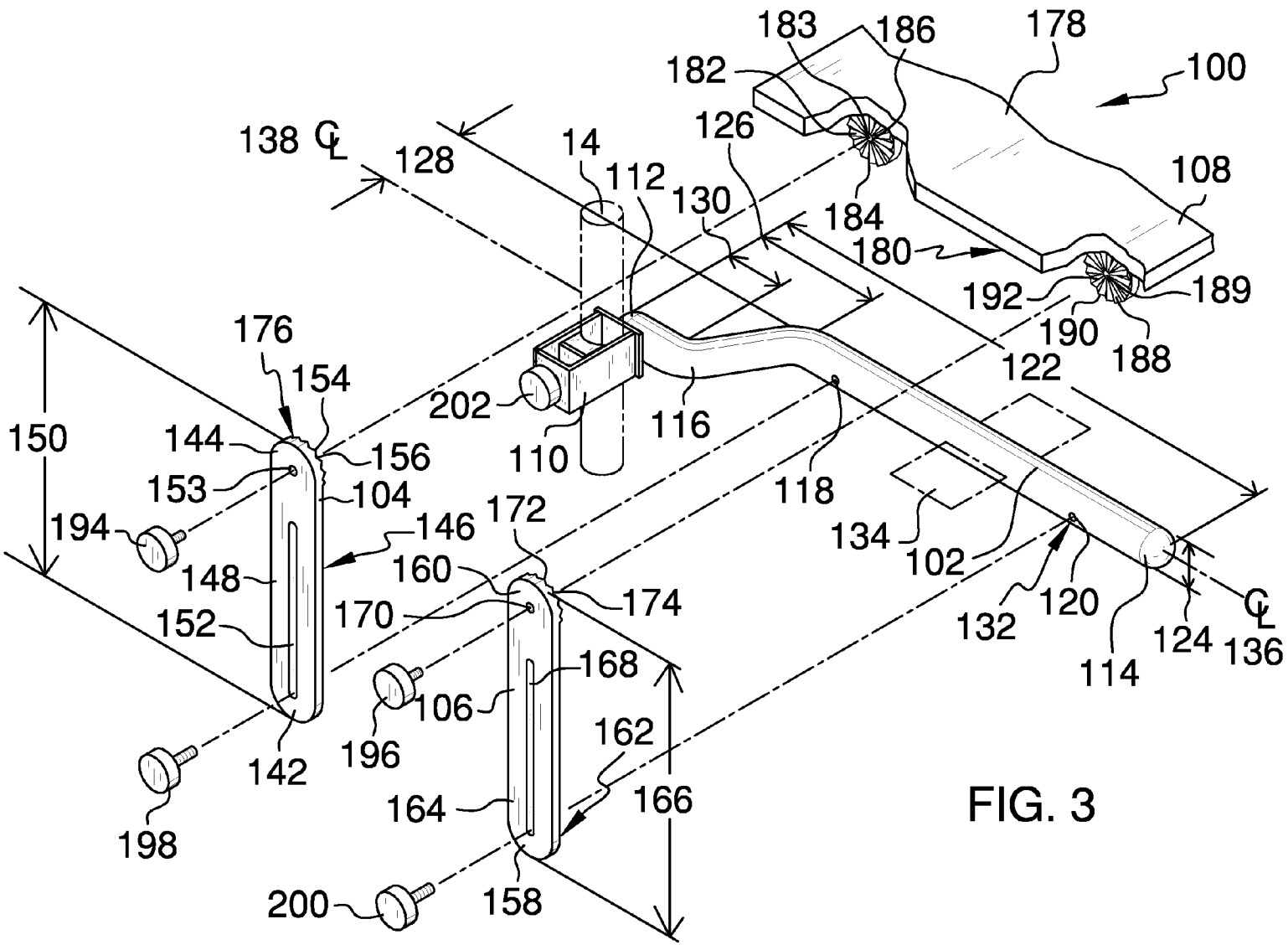
FIG. 3 is an exploded isometric partial view of tray 100.

FIG. 3 is an exploded isometric partial view of tray 100. Support rod 102 may be an elongated hollow tube having a first cap 112, a second cap 114, an offset 116, a first threaded hole 118, and a second threaded hole 120. Support rod 102 may be defined approximate measurements, including a support rod length 122 as measured between first cap 112 and second cap 114, a support rod diameter 124, an offset length 126 as measured from first cap 112 an offset width 128, and an offset clearance 130.

First cap 112 and second cap 114 may be covers that may enclose a hollow interior 132 of support rod 102. If hollow interior 132 were left open, children might hurt their fingers by inserting them into hollow interior 132. First cap 112 and second cap 114 work to prevent harm to children and others who might stick their fingers in hollow interior 132.

Offset 116 may be a bend formed into support rod 102 within a horizontal plane 134 passing through a first support rod centerline 136 and a second support rod centerline 138. This bend assists in centering table 108 on chair opening 12 (FIG. 1). In addition, offset 116 may provide an open gap 140 (FIG. 1) between chair upright portion 14 of chair 10 and an edge of table 108 to reduce a feeling of being trapped within chair 10.

In one example, support rod length 122 approximately may be sixteen inches, support rod diameter approximately may be ½ to one inch, offset length 126 approximately may be three to five inches, support rod diameter 124 may be ¼ inch to one inch, preferably ½ inch, offset width 128 as measured from second support rod centerline 138 to first support rod centerline 136 approximately may be three inches, and offset clearance 130 as measured from first cap 112 along second support rod centerline 138 approximately may be one to four inches. In another example, a ratio of support rod length 122 to offset length 126 may be 4:1. When table 108 is positioned parallel to support rod 102, table 108 may be parallel to offset 116.

First threaded hole 118 and second threaded hole 120 may be internally threaded openings within support rod 102 configured to receive an externally threaded bolt. Alternatively, first threaded hole 118 and second threaded hole 120 each may receive a grommet that includes an extended internally threaded interior. In one example, support rod 102 contains no holes other than first threaded hole 118, second threaded hole 120, and those openings closed by first cap 112 and second cap 114.

First linkage 104 and second linkage 106 may permit a user to raise and lower table 108 relative to their lap, move table 108 closer to and away from their torso, and tilt table 108 at an angle relative to horizontal plane 134 (FIG. 3), or adjust table 108 to be horizontal.

First linkage 104 may include first linkage bottom 142, a first linkage top 144, a first linkage front side 146, a first linkage back side 148, a first linkage length 150, a first linkage slot 152 extending from first linkage bottom 142 along more than ¾ of first linkage length 150, a first linkage through hole 153, and first linkage cams 154 interleaved with first linkage grooves 156. Second linkage 106 may include second linkage bottom 158, a second linkage top 160, a second linkage front side 162, a second linkage back side 164, a second linkage length 166, a second linkage slot 168 extending from second linkage bottom 158 along more than ¾ of second linkage length 166, a second linkage through hole 170, and second linkage cams 172 interleaved with second linkage grooves 174. First linkage 104 and second linkage 106 may have similar constructions. For example, each approximately may be ¼-inch thick.

In one example, first linkage length 150 approximately may be seven to ten inches and first linkage slot 152 approximately ma be ¼-inch wide. First linkage cams 154 and first linkage grooves 156 both may extend away from first linkage front side 146, but first linkage cams 154 may extend further away from first linkage front side 146 than first linkage grooves 156 to create projections. First linkage cams 154 and first linkage grooves 156 may radiate outward from first linkage through hole 153 to a first linkage perimeter 176 to form wedge projections and wedge indentations.

Table 108 may be a platform having a table top 178 and a table underside 180. Both table top 178 and table underside 180 may be smooth and flat. Attached to table underside 180 may be a first bracket 182 having a first bracket threaded hole 183 and first bracket cams 184 interleaved with first bracket grooves 186 and a second bracket 188 having a second bracket threaded hole 189 and second bracket cams 190 interleaved with second bracket grooves 192. First bracket 182 and second bracket 188 may be L-shaped and may have similar construction. Both brackets may extend far enough away from table underside 180 to receive linkages 104, 106 and permit them to rotate.

Tray 100 may include a first knob 194, a second knob 196, a third knob 198, a fourth knob 200, and a fifth knob 202. Knobs 194, 196, 198, and 200 may include a head with one side of the head having radial teeth and a threaded bolt extending from that side having radial teeth. The radial teeth may grip and seat a mating surface.

First linkage 104 and first bracket 182 may be secured together by inserting first knob 194 through first linkage through hole 153 and screwing first knob 194 into first bracket threaded hole 183. Second linkage 106 and second bracket 188 similarly may be secured together by second knob 196. First linkage cams 154 may be configured to mate with first bracket grooves 186 and first linkage grooves 156 may be configured to mate with first bracket cams 184 such that, when compressed together by the tightening action of first knob 194, first linkage 104 and first bracket 182 may be prevented from rotating relative to each other. Along with a similar interaction between second linkage 106 and second bracket 188, this may prevent table 108 from moving away from or closer to the user.

Figure 4:
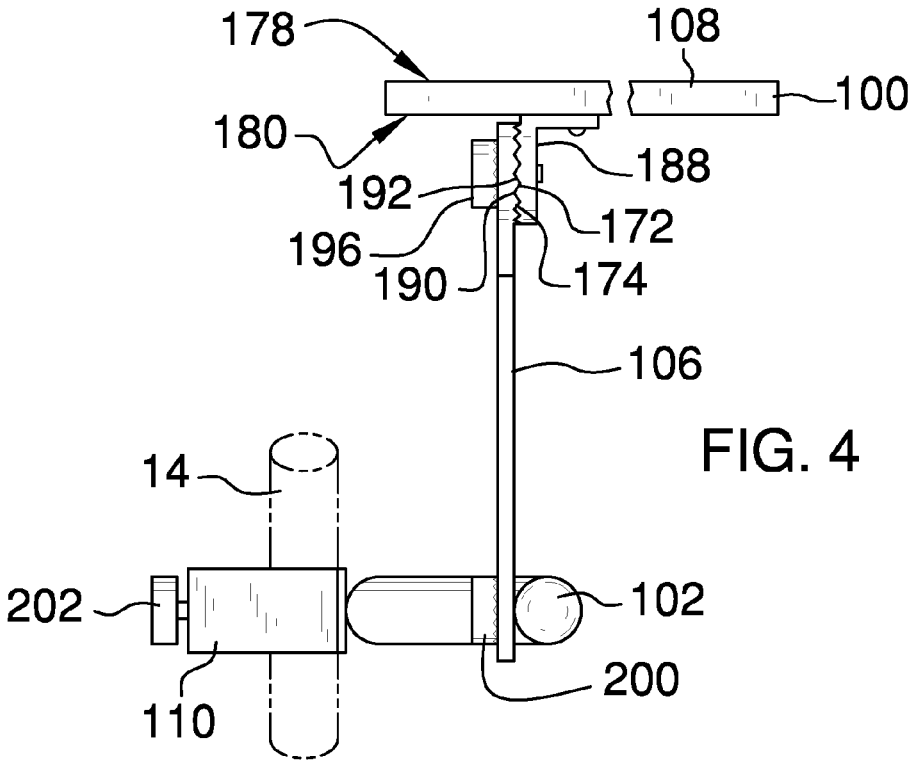
FIG. 4 is rear view of tray 100.

FIG. 4 is rear view of tray 100. As illustrated, second linkage cams 172 mate with second bracket grooves 192 and second linkage grooves 174 may be configured to mate with second bracket cams 190 such that, when compressed together by the tightening action of second knob 196, second linkage 106 and second bracket 188 may be prevented from rotating relative to each other.

Figure 5:
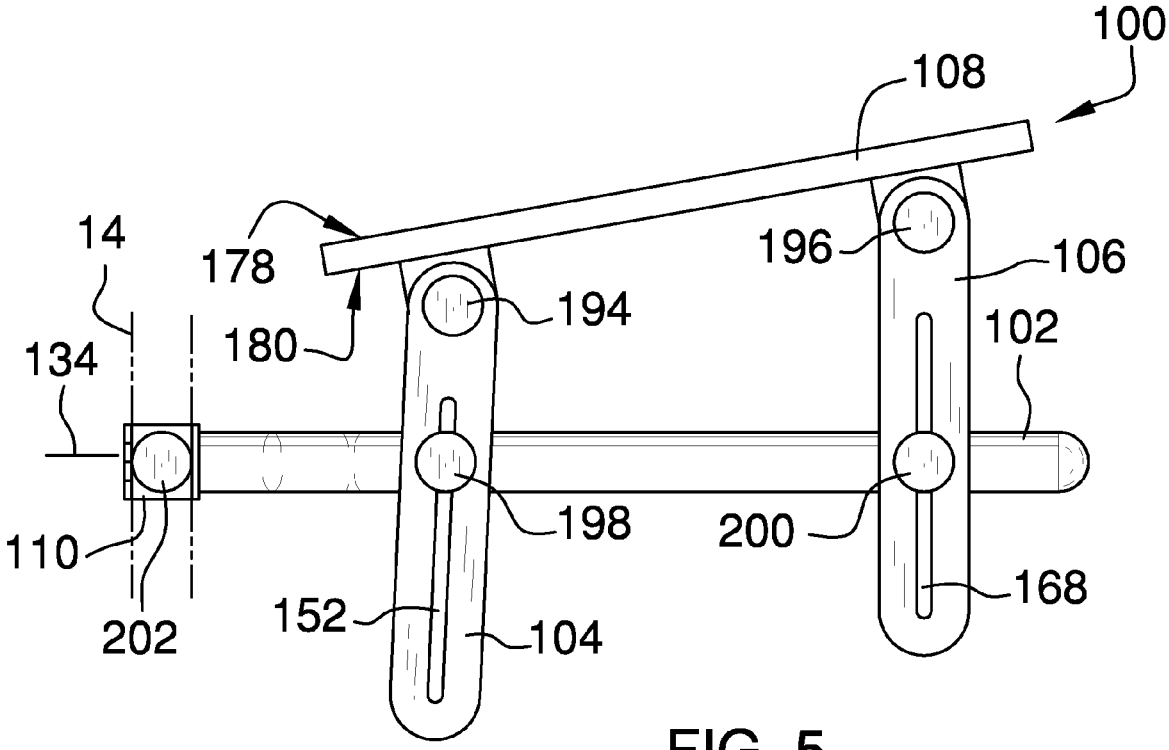
FIG. 5 is a right side view of tray 100.

FIG. 5 is a right side view of tray 100. First linkage 104 may be attached to support rod 102 by passing third knob 198 through first linkage slot 152 and screwing third knob 198 into first threaded hole 118 (FIG. 3). Second linkage 106 may be attached to support rod 102 by passing fourth knob 200 through second linkage slot 168 and screwing fourth knob 200 into second threaded hole 132 (FIG. 3).

As noted above, first linkage 104 and second linkage 106 may permit a user to raise and lower table 108 relative to their lap, move table 108 closer to and away from their torso, and tilt table 108 at an angle relative to horizontal plane 134 (FIG. 3) or adjust table 108 to be horizontal. Each of these may be accomplished by loosening different combinations of first knob 194, second knob 196, third knob 198, and fourth knob 200, raising, rotating, and/or angling table 108, then tightening first knob 194, second knob 196, third knob 198, and fourth knob 200 to secure table 108 in position. When table 108 is positioned parallel to support rod 102, table 108 may be parallel to offset 116.

Figure 6:
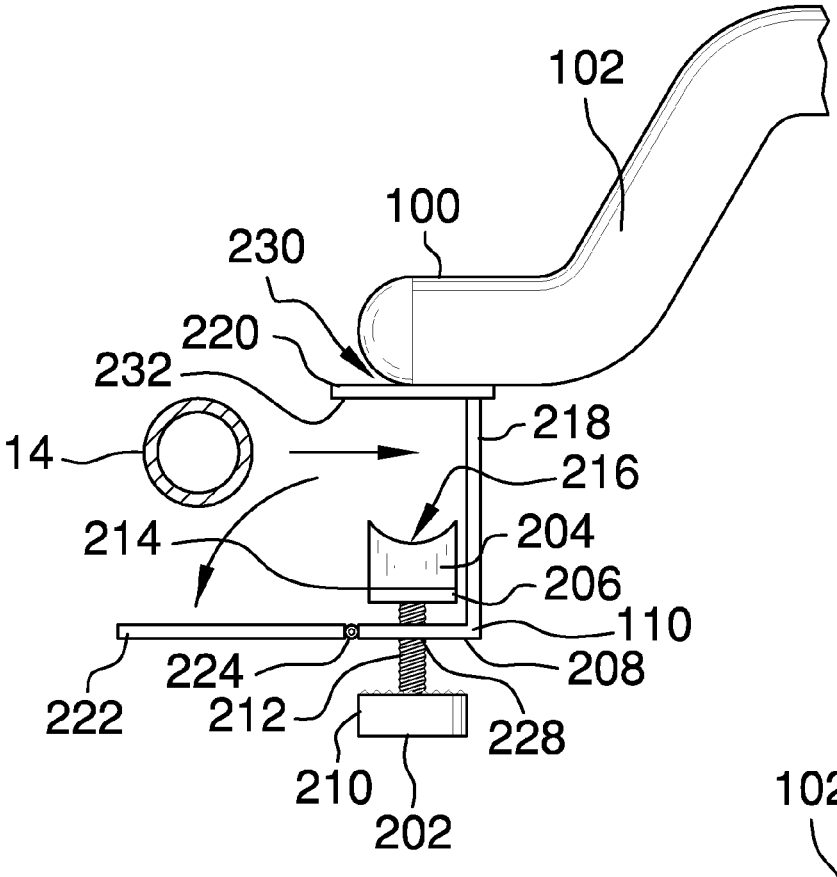
FIG. 6 is a top partial view of tray 100.

FIG. 6 is a top partial view of tray 100. As noted above, clamp 110 may be utilized to attach tray 100 to chair upright portion 14 of chair 10. Clamp 110 also may permit a user to raise and lower table 108 along chair upright portion 14 and rotate table 108 about chair upright portion 14 to move table 108 into position for use and move table 108 out of the way so that a user may get in and out of chair 10 (FIG. 1) more easily.

Clamp 110 may include fifth knob 202, a stopper 204, a push plate 206, and a clamp housing 208. Fifth knob 202 may include a knob head 210 and a threaded bolt 212 extending from knob head 210. Stopper 204 may be a solid cylindrical cap having a flat stopper end 214 and a concave end 216 configured to engage a profile of chair upright portion 14. Concave end 216 may be semicylindrical, U-shaped, or V-shaped, for example, to better mate with a curved or rectangular profile of chair upright portion 14. Stopper 204 may be attached to push plate 206 and push plate 206 may be attached to threaded bolt 212. Stopper 204 may be rubber or metal.

Clamp housing 208 may include a clamp wall 218 welded to a clamp mounting surface 220. Clamp housing 208 also may include a door 222 attached to clamp wall 218 by a hinge 224 and a clamp housing threaded hole 228 located in clamp wall 218 opposite of clamp mounting surface 220. Clamp 110 may be secured to support rod 102 by a weld 230 located between clamp mounting surface 220 and support rod 102.

Figure 7:
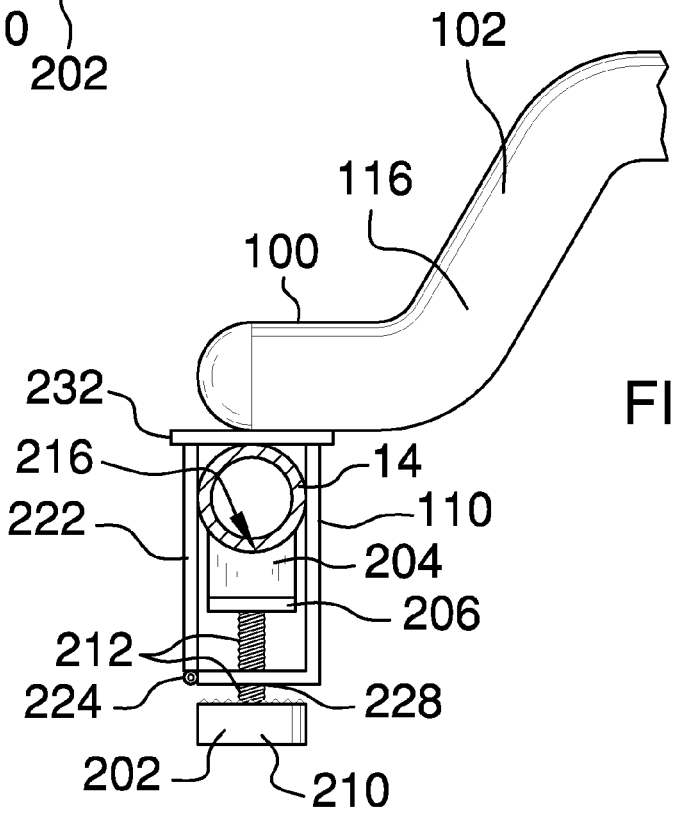
FIG. 7 is a top partial view of tray 100 with clamp 110 attached to chair upright portion 14.

FIG. 7 is a top partial view of tray 100 with clamp 110 attached to chair upright portion 14. In operation, door 222 may be opened (as in FIG. 6) to permit clamp housing 208 to receive chair upright portion 14. With chair upright portion 14 positioned within clamp housing 208, fifth knob 202 may be tightened to cause concave end 216 of stopper 204 to engage chair upright portion 14. Door 222 then may be closed to further limit movement of chair upright portion 14 and secured to clamp mounting surface 220 by a door hook 232 that may mate with a hole. Fifth knob 202 then may be tightened until tray 100 is secured to chair 10 (FIG. 1).

Figure 8:
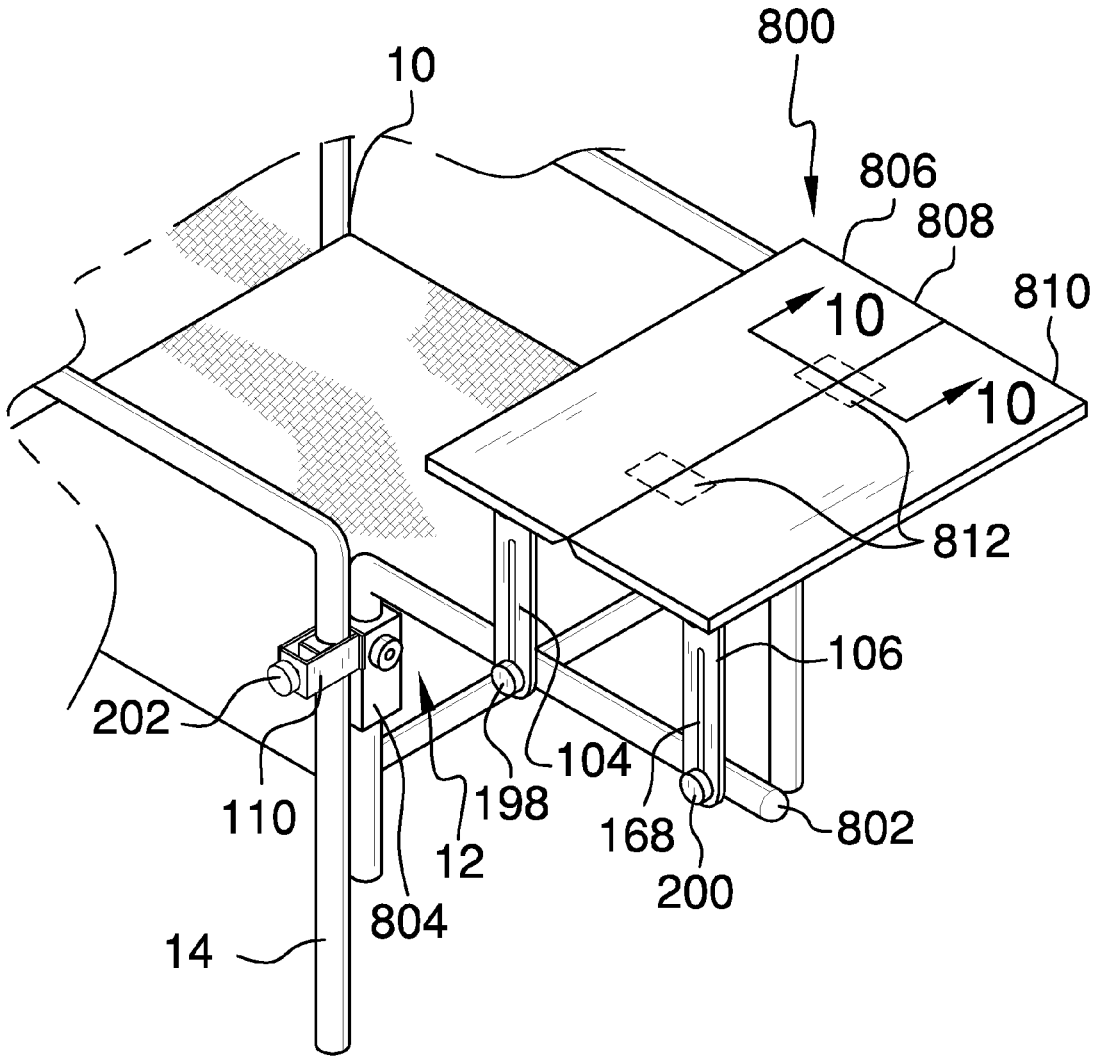
FIG. 8 is an isometric view of a tray 800 attached to chair 10.

FIG. 8 is an isometric view of a tray 800 attached to chair 10. Tray 800 may have features similar to tray 100 with some differences. In this example, the support rod of tray 800 may be "L" shaped rather than include offset 116 to permit moving the tray up and down and rotating the tray relative to chair 10 without having to release clamp 110. In addition, the table may be formed from two halves, hinges to permit folding the two halves together for shipping. In this regard, tray 800 may include a support rod 802, a support rod clamp 804, and a table 806 having a first leaf 808, a second leaf 810, and hinges 812.

Figure 9:
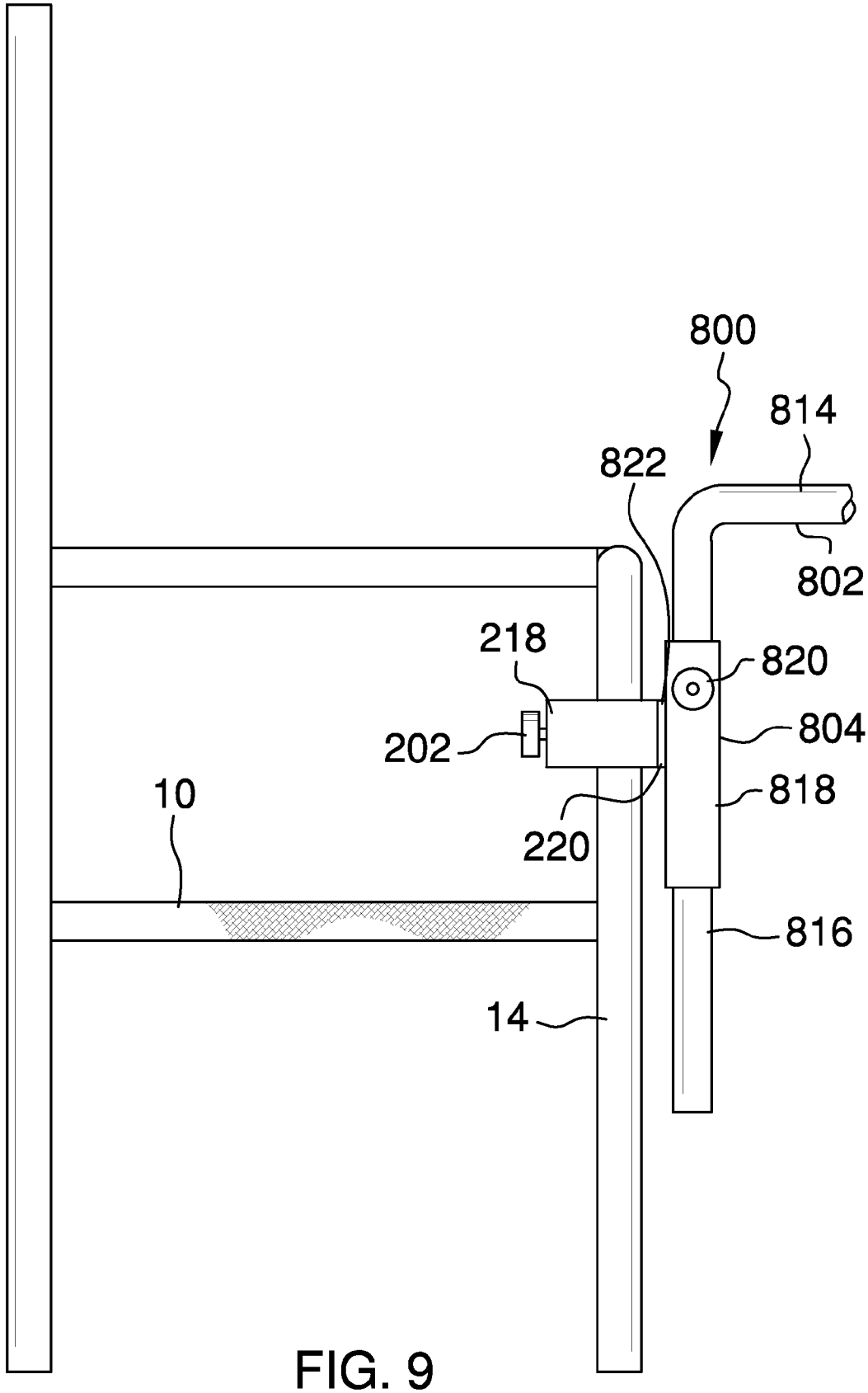
FIG. 9 is a side view of tray 800.

FIG. 9 is a side view of tray 800. Support rod 802 may be an "L" shaped support rod that may support table 806 through brackets 104, 108 to chair 10 through support rod clamp 804 and clamp 110. Support rod 802 may include a support rod horizontal portion 814 and a support rod vertical portion 816 connected approximately at ninety degrees to support rod horizontal portion 814.

Support rod clamp 804 may include a support rod clamp tube 818 having a sixth knob 820 removeably secured there through. Support rod clamp tube 818 may be hollow to receive support rod vertical portion 816 and permit support rod vertical portion 816 to move up and down and rotate relative to support rod clamp tube 818. Similar to knobs 194, 196, 198, and 200, sixth knob 820 may include a head with one side of the head having radial teeth and a threaded bolt extending from that side having radial teeth. The radial teeth may grip and seat a mating surface of support rod clamp tube 818. When screwed tight, the threaded bolt of sixth knob 820 may touch and restrain support rod vertical portion 816 from moving through compression. Support rod clamp tube 818 may be attached to clamp mounting surface 220 through a weld 822.

Figure 10:
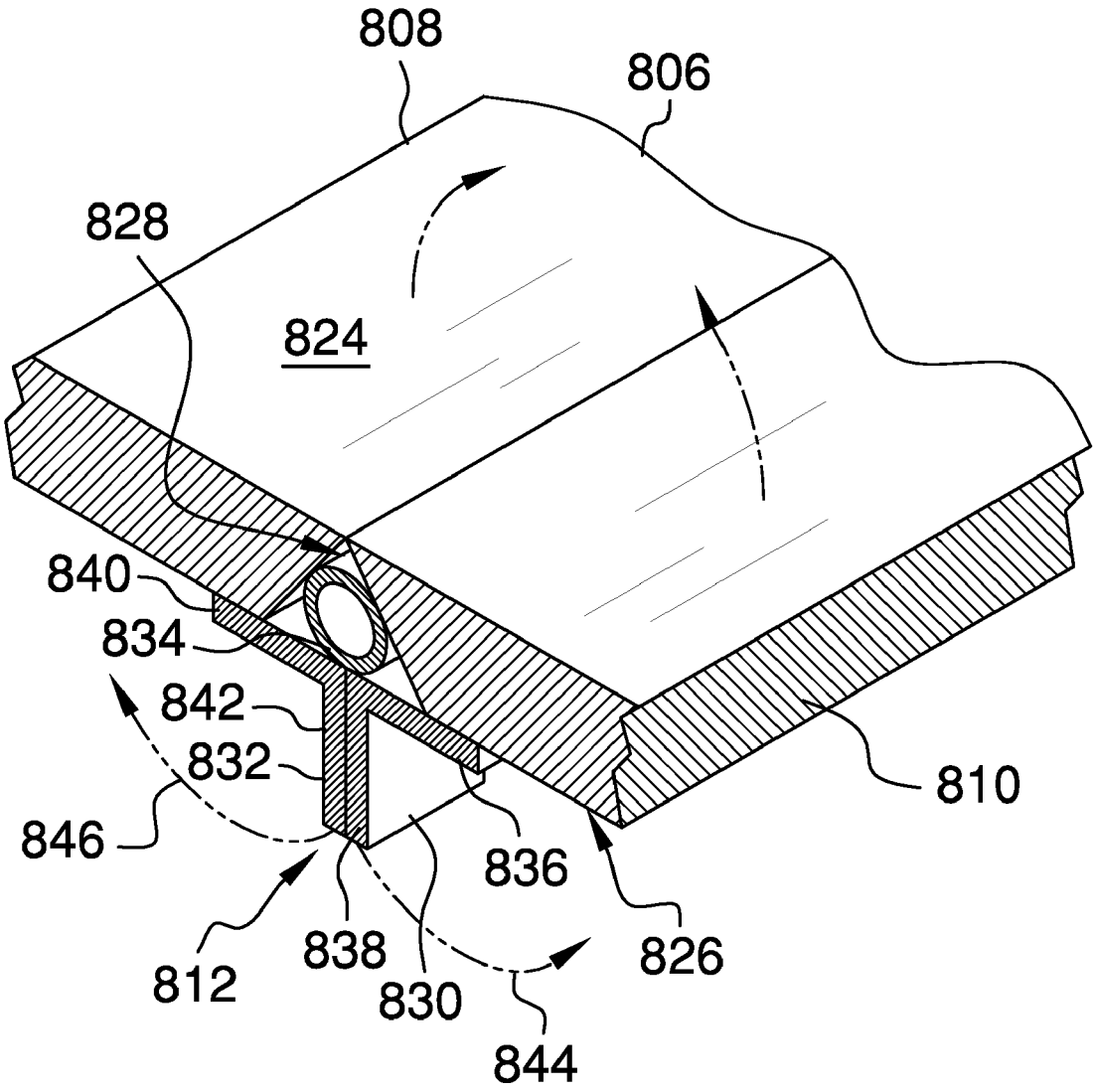
FIG. 10 is a section view of table 806 generally taken off line 10-10 of FIG. 8.

FIG. 10 is a section view of table 806 generally taken off line 10-10 of FIG. 8. As noted, table 806 may include a first leaf 808, a second leaf 810, and hinges 812. Table 806 may be a platform having a table top 824 to receive work items and a table underside 826. First leaf 808 and second leaf 810 each may be a hinged flat section of table 806 that may abut one another to form a flat surface having a table cavity 828 and may fold on top of each other to reduce a size of table 806.

Hinges 812 may be a jointed or flexible device that may permit pivoting first leaf 808 relative to second leaf 810. Hinges 812 may include a first L-bracket 830, a second L-bracket 832, and a pivot 834. First L-bracket 830 may include a first L-bracket base 836 and a first L-bracket projection 838 extending approximately ninety degrees from first L-bracket base 836. Second L-bracket 832 may include a second L-bracket base 840 and a second L-bracket projection 842 extending approximately ninety degrees from second L-bracket base 840.

First L-bracket base 836 and second L-bracket base 840 may be attached to table underside 826. First L-bracket 830 and second L-bracket 832 each may be attached to pivot 834. First L-bracket projection 838 and second L-bracket projection 842 may be configured to abut each other and pivot 834 may be positioned in table cavity 828 when table 806 is in an open position. Abutting first L-bracket projection 838 and second L-bracket projection 842 may maintain table 806 in a flat position and prevent the respective leafs from over rotating.

To reduce a size of table 806, table 806 may be removed from brackets 104, 106 by removing first knob 194 and second knob 196 (FIG. 5), respectively. With table 806 free from brackets 104, 106, first L-bracket projection 838 and second L-bracket projection 842 may be configured to move about pivot 834 in a direction of first arrow 844 and second arrow 846, respectively so that table top 824 of first leaf 808 and table top 824 of second leaf 810 may come into contact with one another.

The tray may be secured to a portable chair such as a wheelchair and may function as an eating, writing, drawing, or studying table or platform. The tray may be produced from a durable plastic or aluminum and may measure 12 to 16 inches long, ½ inch wide, and may feature an adjustable height. The tray may include a clamp that may enable the tray to be secured to one of the front uprights of a chair. This clamping mechanism may feature a twist knob that may enable the tray to be secured to the upright. This clamp may secure a lower support of the tray to the chair.

Two upward extending uprights may be connected to the support with pivoting hardware. This hardware may enable the uprights and the tray mounted to the top of them to be pivoted up and down on demand. When the tray is pivoted upward, it may be in a functional position. A person may now utilize the tray to eat, write, read, and study. A level is an indicator that may establish the horizontal when a bubble is centered in a tube of liquid. The tray may include a level attached to the table to assist a user to position the table horizontally or at a desired angle with more precision. Thus, even if the chair is not level, the table may be adjusted to be level. The tray may include sports logos, such as for football and baseball.

When the tray is collapsed, the tray may feature a low profile. This low profile may create a compact unit that may be easily carried and stored after it had been removed from the chair. The tray may include a carrying case and a spring clip may be attached to a top of the table. Metal and/or rubber washers may be provided between mating surfaces.

The tray may fulfill a need for a tray that may be secured to a portable chair that may function as an eating, writing, drawing, and/or studying platform. Appealing features of the tray may include its compactness and portability, ease of attachment and use, convenience, durability, functional versatility, and ease of storage. The tray may be utilized by homeowners, campers, anglers, and outdoor sporting event spectators. Disabled persons in a wheelchair may use the tray as well The information disclosed herein is provided merely to illustrate principles and should not be construed as limiting the scope of the subject matter of the terms of the claims. The written specification and figures are, accordingly, to be regarded in an illustrative rather than a restrictive sense. Moreover, the principles disclosed may be applied to achieve the advantages described herein and to achieve other advantages or to satisfy other objectives, as well.

What is claimed is:

1. A tray for a portable chair, the tray comprising:

a support rod;

a table;

a first linkage attached between the support rod and the table, where the first linkage includes a first linkage slot;

a second linkage attached between the support rod and the table; and a clamp attached to the support rod;

where the table includes a first leaf and a second leaf, the tray further comprising: a hinge having a pivot, where the first leaf and second leaf are connected and abutted against each other by the hinge;

where the hinge includes a first L-bracket fixed to a bottom of the first leaf and includes a second L-bracket fixed to a bottom of the second leaf such that the first L-bracket and the second L-bracket press against each other when the first leaf and the second leaf are in a same plane and parallel to each other;

where the support rod is a hollow tube and includes a support rod horizontal portion having a first cap attached to a first end opening.

2. The tray of claim 1, where the support rod includes a first threaded hole and a second threaded hole and where the support rod contains no holes other than the first threaded hole, the second threaded hole, the first end opening, and a second end opening.

3. The tray of claim 1, where a support rod horizontal portion length of the support rod approximately is sixteen inches.

4. The tray of claim 2, where the support rod has a structure that includes only the support rod horizontal portion and a support rod vertical portion connected approximately at ninety degrees to the support rod horizontal portion.

5. The tray of claim 1, where the first linkage includes a first linkage through hole and first linkage cams interleaved with first linkage grooves.

6. The tray of claim 5, where the first linkage further includes a first linkage bottom, a first linkage top, a first linkage front side, a first linkage back side, a first linkage length, where the first linkage slot extends from the first linkage bottom along more than ¾ of the first linkage length.

7. The tray of claim 6, where the second linkage and first linkage are interchangeable.

8. The tray of claim 6, where the first linkage cams and the first linkage grooves both extend away from the first linkage front side with the first linkage cams configured to extend further away from the first linkage front side than the first linkage grooves.

9. The tray of claim 1, where the table is a two piece platform having a table top and a table underside, the tray further comprising:

a first bracket having a first bracket threaded hole and first bracket cams interleaved with first bracket grooves, where the first bracket is attached to the table underside.

10. The tray of claim 9, where the first bracket is L-shaped, the tray further comprising:

a first knob attached to the first linkage and the first bracket;

the second knob attached to the second linkage and the second bracket;

a third knob attached to the first linkage and the support rod;

a fourth knob attached to the second linkage and the support rod; and a fifth knob attached to the clamp.

11. The tray of claim 10, where the first knob, the second knob, the third knob, and the fourth knob each includes a head with one side of the head having radial teeth and a threaded bolt extending from that side having radial teeth and where the fifth knob includes a head and a threaded bolt extending from the head but does not include radial teeth.

12. The tray of claim 1, where the clamp includes a fifth knob, a stopper, a push plate, and a clamp housing, where the fifth knob includes a knob head and a threaded bolt extending from knob head, where the stopper is a cap having a flat stopper end and a concave end configured to engage a profile of a chair upright portion of the portable chair, where the clamp housing includes a clamp wall welded to a clamp mounting surface.

13. The tray of claim 12, where the clamp housing further includes a door attached to the clamp wall by a hinge and includes a clamp housing threaded hole located in clamp wall opposite of the clamp mounting surface, where the clamp is secured to the support rod by a weld located between the clamp mounting surface and the support rod, where the concave end of the stopper is V-shaped and the stopper is made of metal.

14. The tray of claim 1, where the support rod is "L" shaped and includes the support rod horizontal portion and a support rod vertical portion connected approximately at ninety degrees to the support rod horizontal portion, the tray further comprising:

a support rod clamp having a support rod clamp tube and a sixth knob removeably secured through the support rod clamp tube, where the support rod clamp tube is hollow and configured to receive the support rod vertical portion and the sixth knob is configured to touch and restrain the support rod vertical portion from moving relative to the support rod clamp tube.

15. The tray of claim 1, where the first leaf is position parallel to the second leaf to form a table top and the first leaf and the second leaf are configured to be folded together to reduce a size of the table.

* * * * *